US006841064B1

(12) United States Patent
Weiss et al.

(10) Patent No.: US 6,841,064 B1
(45) Date of Patent: Jan. 11, 2005

(54) PROCESS FOR THE GENTLE FLASH DISTILLATION OF RESIDUAL OILS

(75) Inventors: Hans-Jürgen Weiss, Oberursel (DE); Ingo Dreher, Oberursel (DE); Udo Zentner, Griesheim (DE)

(73) Assignee: MG Technologies AG, Frankfurt am Main (DE)

( * ) Notice: Subject to any disclaimer, the term of this patent is extended or adjusted under 35 U.S.C. 154(b) by 280 days.

(21) Appl. No.: 10/148,826

(22) PCT Filed: Nov. 16, 2000

(86) PCT No.: PCT/EP00/11320

§ 371 (c)(1),
(2), (4) Date: Oct. 3, 2002

(87) PCT Pub. No.: WO01/42394

PCT Pub. Date: Jun. 14, 2001

(30) Foreign Application Priority Data

Dec. 10, 1999 (DE) ..... 199 59 587

(51) Int. Cl.[7] ..... B01D 3/06; B01D 3/00
(52) U.S. Cl. ..... 208/361; 208/365
(58) Field of Search ..... 208/361, 365

(56) References Cited

U.S. PATENT DOCUMENTS 3,962,043 A 6/1976 Schmalfeld et al. ..... 201/21
4,054,492 A 10/1977 Rammler et al. ..... 201/12
6,413,415 B1 * 7/2002 Weiss et al. ..... 208/361

FOREIGN PATENT DOCUMENTS

DE 197 24 074 C2 12/1998

OTHER PUBLICATIONS

Abstract—DE 197 24 074A—Publication Date Dec. 10, 1998.

* cited by examiner

*Primary Examiner*—Walter D. Griffin
*Assistant Examiner*—Tam Nguyen
(74) *Attorney, Agent, or Firm*—Norris McLaughlin & Marcus PA

(57) ABSTRACT

Residual oil from the processing of crude oil, natural bitumen or oil sand is mixed in a mixer with granular, hot coke as heat carrier (heat carrier coke) in a weight ratio of 1:3 to 1:30, where on the granules of the heat carrier coke there is first of all formed a liquid residue film which partly evaporates in the mixer. Gases and vapors and moist, sticky coke are withdrawn from the mixer. The mixture of coke and residual oil is introduced into a subsequently connected stirred tank in which the mixture slowly moves downwards while being stirred mechanically at a temperature of 450 to 600° C. and preferably at 480 to 550° C. Dry, flowable coke is withdrawn from the stirred tank. Usually, the dwell time of the heat carrier coke in the stirred tank is 1 to 30 minutes.

6 Claims, 2 Drawing Sheets

PROCESS FOR THE GENTLE FLASH DISTILLATION OF RESIDUAL OILS

DESCRIPTION

This invention relates to a process for the gentle flash distillation of a residual oil from the processing of crude oil, natural bitumen or oil sand, wherein the residual oil is mixed in a mixer with granular, hot coke as heat carrier (heat carrier coke) in a weight ratio of 1:3 to 1:30, and due to the mixing process in the mixer a liquid residue film is first of all formed on the granules of the heat carrier coke, which residue film partly evaporates in the mixer. The gases and vapors formed are withdrawn from the mixer.

Such process is known from DE-A-197 24 074, wherein one or several mixers are employed, which have intermeshing screws rotating in the same direction. It was found out that in this process it is complex or difficult to achieve solid dwell times of more than 120 seconds.

It is the object underlying the invention to develop the known process and to produce a rather high yield of product oil of the best quality possible in an inexpensive way. In accordance with the invention this is achieved in that the mixture of coke and residual oil formed in the mixer is introduced into a subsequently connected stirred tank in which the mixture slowly moves downwards while being stirred mechanically at a temperature of 450 to 600° C. and preferably at 480 to 550° C., and that dry, flowable coke is withdrawn from the stirred tank. This flowable coke is largely free from liquid residual oil and therefore exhibits a good flow behavior.

In the process in accordance with the invention, the dwell times of the heat carrier coke in the mixer usually are 1 to 120 seconds and in the stirred tank 1 to 30 minutes. As mixer, there is advantageously used one with two or more horizontal intermeshing screws, which is already known. This mixer can be built with a relatively short length, so that the dwell times of the gases and vapors in the mixer are also short and usually amount to 0.5 to 5 seconds.

Coke-containing solids from the mixer, which are still moist and sticky, are charged into the subsequently connected stirred tank. The content of residual oil in the mixer, which residual oil is charged into the stirred tank, still is 5 to 90 wt-% and mostly 10 to 70 wt-% of the amount of residual oil supplied to the mixer. The stirred tank in which the solids gradually move downwards may have a single impeller shaft or also several impeller shafts. Thorough mixing promotes the withdrawal of the gases and vapors released, which are withdrawn from the stirred tank and, like the gases and vapors withdrawn from the mixer, are supplied to a condensation.

Stirring in the stirred tank is necessary because the residual oil is a bituminous binder which leaves a coke residue, and it must be prevented that the solid particles agglomerate to form large lumps. Lumps formed are broken again by the stirrer, so that the flow property of the heat carrier is maintained. In the stirred tank, long dwell times can easily be achieved, whereas with equal dwell times mixers with horizontal, intermeshing screws would have to be built with too much length, which on the one hand would be mechanically difficult and on the other hand complex and expensive.

Embodiments of the process will be explained with reference to the drawing, wherein.

Figure 1:
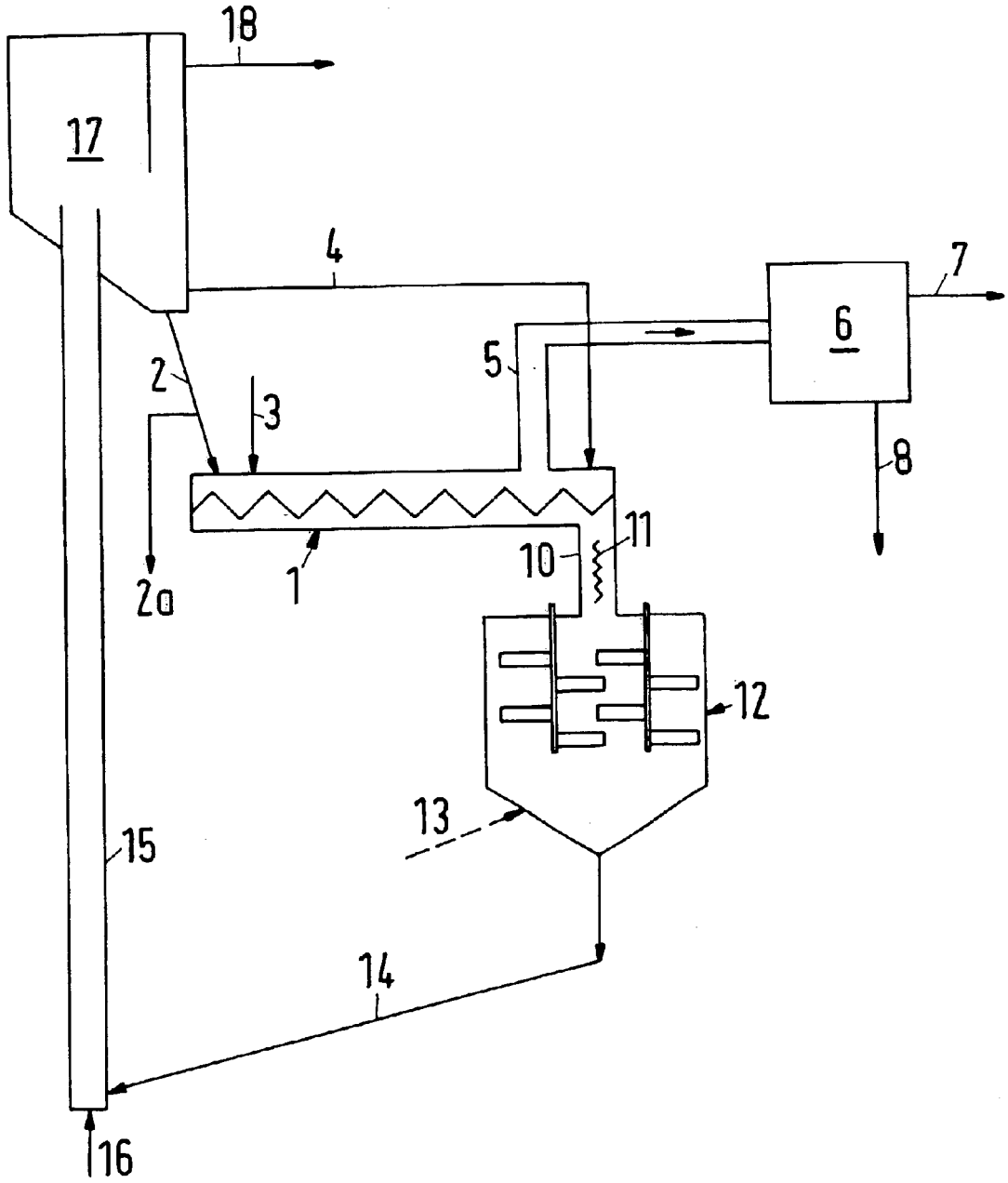
FIG. 1 shows a flow diagram of the process.

In the mixer 1 of FIG. 1, hot heat carrier coke is introduced through line 2, and the residual oil to be processed is introduced through line 3. The heat carrier coke has temperatures in the range from 500 to 700° C., and heat carrier coke and residual oil are supplied to the mixer 1 in a weight ratio of 3:1 to 30:1. In the present case, the mixer 1 has a plurality of horizontal, intermeshing screws, as is known per se. In the mixer 1, temperatures in the range from 450 to 600° C. and mostly 480 to 550° C. are obtained. Gases and vapors formed leave the mixer 1 after a short dwell time in the range from 0.5 to 5 sec through the discharge duct 5 and are introduced into a condensation 6. From this condensation, gases are separately withdrawn through line 7, and crude product oil is withdrawn through line 8, which crude product oil can be supplied to a further treatment not represented.

The coke-containing solids mixture, which has passed through the mixer 1 and has arrived at the outlet passage 10, still has a residual content of residual oil of 5 to 90 wt-%, based on the amount supplied through line 3. Therefore, the mixture still is moist and sticky, so that there is expediently used a mechanical cleaning device 11 (e.g. screw, scraper), in order to avoid deposits and agglutinations in the passage 10.

In the stirred tank 12, the mixture of solids and residual oil is stirred mechanically while it moves downwards, the temperatures being maintained in the range from 450 to 600° C. and mostly in the range from 480 to 550° C. The dwell times of the solids in the stirred tank lie in the range from 1 to 30 min and preferably amount to at least 3 min. Hence it is possible to also use rather low temperatures in the stirred tank, in order to convert the residual oil to oil vapor, gas and coke. In the present case, gases and vapors formed flow upwards through the passage 10 and along with the gases and vapors from the mixer 1 reach the condensation 6 through the discharge duct 5.

It may be expedient to introduce a stripping gas (e.g. steam, $C_4$-hydrocarbon gas or nitrogen) into the lower portion of the stirred tank 12, as is indicated by the broken line 13.

When the coke reaches the lower portion of the stirred tank 12, it is dry and flowable. This coke is withdrawn through line 14 and supplied to a pneumatic conveyor 15. Combustion air, which is preferably preheated, is introduced through line 16 into the pneumatic conveyor, and it is also possible to introduce additional fuel. In the conveyor 15, the additional fuel and/or part of the coke is burnt, the remaining coke is heated and introduced into the collecting bin 17. Exhaust gases leave the collecting bin through line 18, and the hot coke, which has temperatures in the range from 500 to 700° C., accumulates in the lower portion of the bin 17. From here, it is supplied as heat carrier coke through line 2 into the mixer 1 in the manner already described above. A partial stream of 1 to 30 wt-%, based on the total amount of heat carrier coke supplied to the distillation, can be supplied through line 4 to the end of the mixer 1. This additional heat carrier coke will then chiefly become effective in the solids mixture introduced into the stirred tank 12. By means of this second addition of coke the mixture of coke and residual oil in the stirred tank can additionally be heated, which accelerates the conversion of the residual oil on top of the coke. In contrast to the representation of FIG. 1, the heat carrier coke supplied through line 4 can also be introduced into the vertical portion of the discharge duct 5, where the hot heat carrier coke removes accretions and recirculates the same to the mixer 1. Excess coke can be withdrawn from the coke circuit through line 2*a*.

Figure 2:
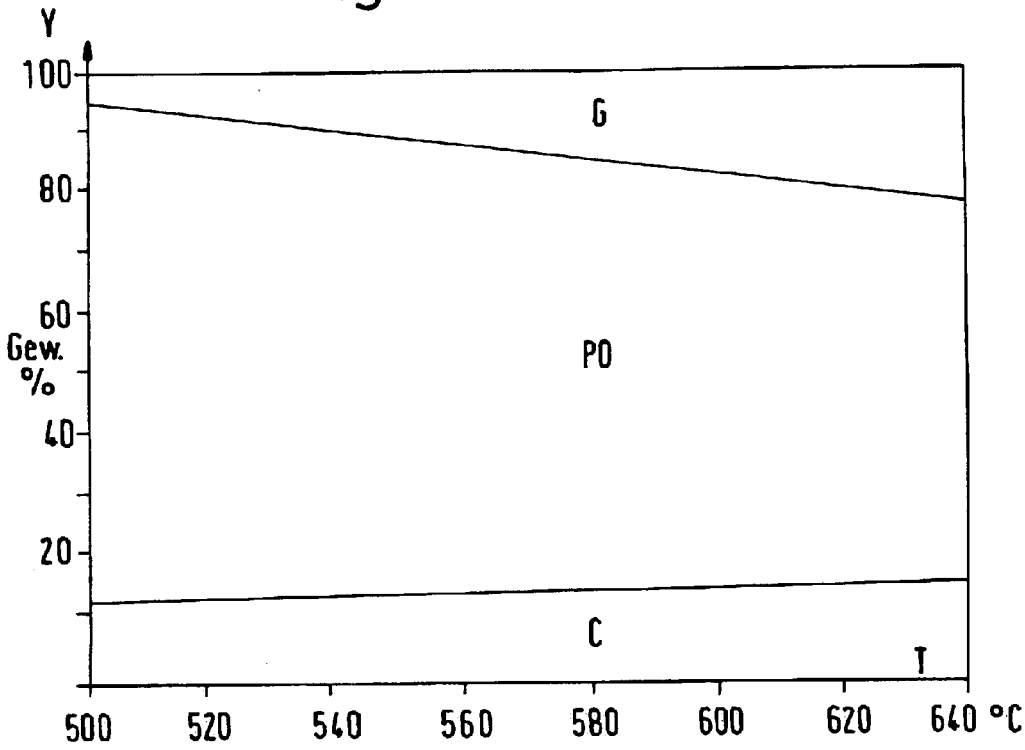
FIG. 2 shows a diagram indicating yields as a function of the reaction temperature.
Figure 3:
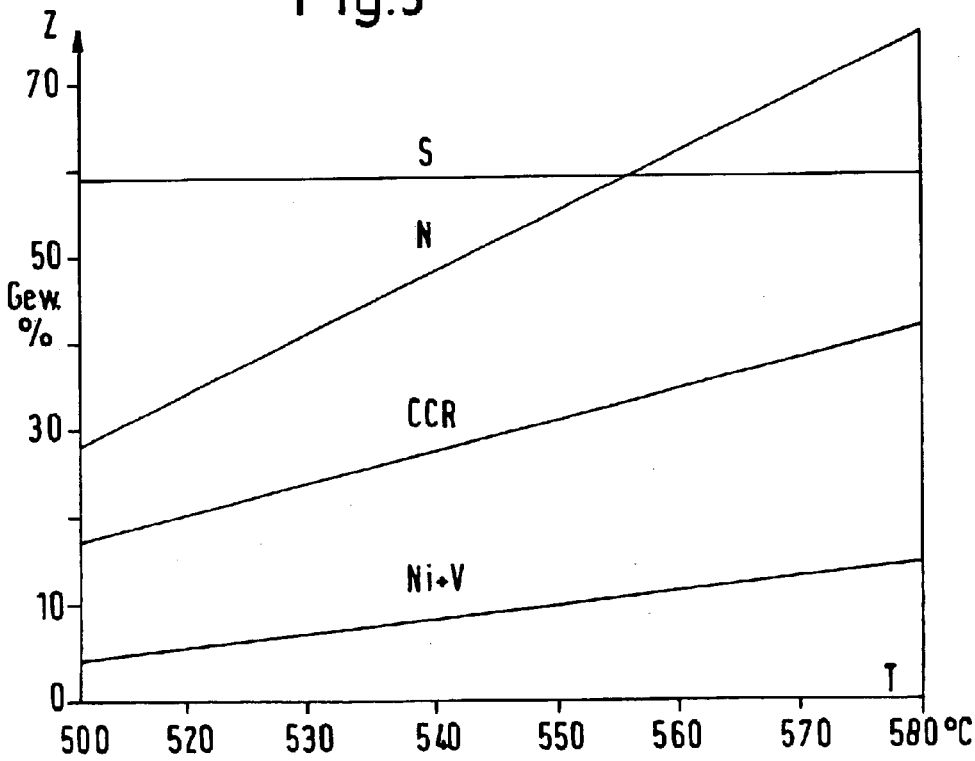
FIG. 3 shows a diagram indicating pollutants in the product oil as a function of the reaction temperature.

Explanations on FIGS. 2 and 3: Experiments performed revealed that with decreasing reaction temperature (T) both the yield of product oil and the quality of the product oil are increasing.

In FIG. 2, the formed amounts (in wt-%) of coke (C), product oil (PO) and gases (G) up to $C_4$ are represented on the Y-axis.

The valuable range is that of the product oil.

In FIG. 3, the Z-axis indicates the percentage (wt-%) of various pollutants in the product oil, based on the initial content in the treated residual oil, namely for sulfur (S), nitrogen (N), Conradson residue (CCR) and the sum of nickel and vanadium (Ni+V).

It can be seen that at a low reaction temperature both the yield of product oil is higher and the content of pollutants in the product oil is lower. However, at decreasing temperatures the reactions require longer dwell times of the solids, which only with the combination of mixer 1 and stirred tank 12 can be achieved in an economic way.

EXAMPLE

In an arrangement corresponding to FIG. 1, 10 t/h of a vacuum residue obtained in the distillation of crude oil are injected into the mixer 1 with a temperature of 330° C. and mixed with 80 t/h heat carrier coke of 570° C. The vacuum residue contains 20 wt-% CCR, 3 wt-% sulfur, 200 mg/kg vanadium and 100 mg/kg nickel. In the mixer, a reaction temperature of 500° C. is obtained. After about 30 seconds, the still oil-containing heat carrier coke is dropped from the mixer into a stirred tank 12. The residual content of residual oil still is 25 wt-%, based on the amount of residue supplied. Within another 5 minutes, the mixture is reacted in the stirred tank to obtain dry coke (1.2 t/h) as well as oil vapor and gas.

The mixture of oil vapor and gas is withdrawn through the ducts 10 and 5 and supplied to a condensation 6. Corresponding to FIGS. 2 and 3, there are obtained 8.3 t/h product oil ($C_{5+}$) with 4 wt-% CCR, 2.1 wt-% S, 7 mg/kg V and 3.5 mg/kg Ni as well as 500 kg/h gas ($C_{4-}$). The heat carrier coke (80 t/h) as well as the coke freshly formed on its surface are withdrawn from the stirred tank largely free from liquid constituents and thus dry and flowable.

What is claimed is:

1. A process for the gentle flash distillation of a residual oil from the processing of crude oil, natural bitumen or oil sand, which comprises mixing the residual oil with granular hot coke in a mixer, at a residual oil: coke weight ratio of from 1:3 to 1:30, to form a liquid film of residual oil on the granules of the coke, evaporating a part of the liquid film from the granules of coke in the mixer and withdrawing the resulting vapors and gases from the mixer, leaving behind moist, sticky granules of coke, withdrawing the moist, sticky granules of coke from the mixer and introducing them into a stirred tank, moving the granules downwards in the stirred tank while mechanically stirring them at a temperature of from 450° C. to 600° C. to evaporate further amounts of residual oil from the granules, and removing dry flowable coke from the stirred tank.

2. The process of claim 1, wherein the dwell time of the coke in the mixer is from 1 to 120 seconds.

3. The process of claim 1, wherein the dwell time of the coke in the stirred tank is from 1 to 30 minutes.

4. The process of claim 1, wherein additional hot coke is added to the mixture which is withdrawn from the mixer.

5. The process of claim 1, wherein the mixture withdrawn from the mixer comprises from 5 to 90% by weight of the residual oil that was first mixed with the hot coke in the mixer.

6. The process of claim 1 wherein the mixture withdrawn from the mixer is conveyed to the stirred tank through a conduit that is provided with a mechanical cleaner.

* * * * *